US010009674B2

(12) United States Patent
James et al.

(10) Patent No.: US 10,009,674 B2
(45) Date of Patent: Jun. 26, 2018

(54) BARRIERS AND DECORATIVE SIGNAGE

(71) Applicants: Lex James, Kent (GB); Martin Clark, London (GB)

(72) Inventors: Lex James, Kent (GB); Martin Clark, London (GB)

( * ) Notice: Subject to any disclaimer, the term of this patent is extended or adjusted under 35 U.S.C. 154(b) by 0 days. days.

(21) Appl. No.: 15/177,234

(22) Filed: Jun. 8, 2016

(65) Prior Publication Data

US 2016/0366504 A1 Dec. 15, 2016

(30) Foreign Application Priority Data

Jun. 9, 2015 (GB) ..... 1510038.1

(51) Int. Cl.

| | |
|---|---|
| ***H04R 1/02*** | (2006.01) |
| ***G08B 3/10*** | (2006.01) |
| ***G09F 27/00*** | (2006.01) |

(52) U.S. Cl.

CPC ..... *H04R 1/028* (2013.01); *G08B 3/10* (2013.01); *G09F 27/00* (2013.01); *G09F 27/004* (2013.01)

(58) Field of Classification Search

CPC .. G08B 25/016; G08B 13/122; G08B 25/009; B60Q 1/50; B60Q 9/008; B60Q 1/00; B60Q 1/2665; B60Q 1/346; B60Q 1/447; B60Q 1/46; B60Q 7/00; B60Q 9/00; B60Q 1/2676; B60Q 1/323; G06F 1/16; E06B 1/62; E06B 2001/628; G09F 13/22; G09F 27/00; G09F 27/004; G09F 9/33; H04R 1/028

See application file for complete search history.

(56) References Cited

U.S. PATENT DOCUMENTS

| | | | | |
|---|---|---|---|---|
| 4,243,851 | A | 1/1981 | Forney | |
| 7,477,140 | B1 * | 1/2009 | Booth | B60Q 1/302 340/463 |
| 9,489,841 | B1 * | 11/2016 | Huggins | G08G 1/056 |
| 2003/0016840 | A1 | 1/2003 | Sica | |
| 2008/0109309 | A1 * | 5/2008 | Landau | G06Q 30/0267 705/14.64 |
| 2008/0198584 | A1 * | 8/2008 | Fouraux | E04F 13/145 362/147 |
| 2008/0212805 | A1 * | 9/2008 | Fincham | H03G 3/004 381/160 |
| 2009/0064571 | A1 | 3/2009 | Fakhari | |
| 2010/0181030 | A1 | 7/2010 | Smoyer et al. | |
| 2012/0033846 | A1 * | 2/2012 | Kaplan | H04R 1/023 381/386 |

FOREIGN PATENT DOCUMENTS

| | | | |
|---|---|---|---|
| CN | 2476615 | Y | 2/2002 |
| CN | 201678954 | U | 12/2010 |
| CN | 202841491 | U | 3/2013 |
| CN | 103103942 | A | 5/2013 |
| CN | 203176877 | U | 9/2013 |
| KR | 20080003273 | U | 8/2008 |
| KR | 101167016 | B1 | 7/2012 |
| KR | 101393498 | B | 5/2014 |

* cited by examiner

*Primary Examiner* — Mohammad Islam
(74) *Attorney, Agent, or Firm* — EIP US LLP

(57) ABSTRACT

Examples are described relating to an apparatus, a method of manufacture for an apparatus and a system to provide a physical and audible effect. In one exemplary embodiment, the apparatus has an elongate substrate and a plurality of sound producing devices arranged along the elongate substrate.

19 Claims, 9 Drawing Sheets

BARRIERS AND DECORATIVE SIGNAGE

CROSS-REFERENCE TO RELATED APPLICATIONS

This application claims priority to UK Application No. 1510038.1, filed Jun. 9, 2015. The above-referenced patent application is incorporated by reference in its entirety.

BACKGROUND OF THE INVENTION

Field of the Invention

The present invention relates generally to barriers and decorative signage.

Description of the Related Technology

Barriers are known for a number of different applications and purposes. One such application is in construction or repair sites where the purpose may be to demarcate an area where construction or repair is taking place. The barrier typically acts to warn, deter, or impede people or vehicles from entering the area that has been demarcated. Such barriers can take several forms including, for example, barrier tape, plastic fencing, and/or plastic traffic cones.

Barrier tape is sometimes referred to as barricade or construction tape; or when used by emergency services can be referred to as police tape or firefighter tape. In most cases, the barrier tape is a low-cost solution that can be attached quickly to posts or trees to provide a visual indication or sign of a hazardous or sensitive area, as well as a physical barrier to entering that area.

However, known barriers can be improved on.

SUMMARY

According to a first aspect of the present invention, there is provided an apparatus comprising:

an elongate substrate;

at least one electrically conductive element; and, a plurality of sound producing units, wherein the plurality of sound producing units are spaced along the elongate substrate, and wherein the at least one conductive element extends along the elongate substrate and electrically couples to the plurality of sound producing units, and wherein the elongate substrate encloses the plurality of sound producing units.

Suitably, the elongate substrate encloses the plurality of sound producing units in a planar configuration.

An apparatus in accordance with the first aspect of the present invention may be used as a barrier which can advantageously provide an audible output. The audible output in turn can provide an audible warning associated with the barrier.

An apparatus in accordance with the first aspect of the present invention may also be used as a decorative sign or banner which can advantageously provide an audible output. The audible output can provide an audible greeting or message associated with the decorative sign.

An apparatus in accordance with the first aspect of the present invention may advantageously provide a user-controlled audible effect, and which can be easily manufactured, stored, transported and assembled. Other embodiments of the first aspect of the present invention may provide a user with an apparatus with a user-controlled audible effect which can be inexpensive to manufacture, and can therefore be disposable.

In an exemplary embodiment, the substrate is a generally planar substrate. The thickness of the substrate can be significantly smaller than the width of the substrate. For example the thickness may be less than 5 millimeters whereas the width of the substrate may be approximately 30-70 millimeters. The length of the substrate can, for example, extend for several meters.

In an exemplary embodiment, the substrate is flexible. A flexible substrate enables the apparatus to act as a barrier tape or decorative sign which can be, for example, wrapped around posts or held by dedicated barrier fixings. Another advantage of such a flexible barrier is that it could be easily stored for example on a roll or reel. This enables easier transportation of the apparatus. In other embodiments, the apparatus can be flexible so as to stretch when a force is applied to it. In other embodiments, the apparatus can be inflexible so as to be suitable for use in creating a more permanent or sturdy barrier or decorative sign.

In an embodiment, the substrate comprises a flattened tube such that the upper and lower edges are contiguous between the front and back surfaces.

In an embodiment, the substrate comprises a tape folded along its length. The at least one electrically conductive element and plurality of sound producing units can be arranged within a first portion of the substrate. By folding the elongate substrate along a fold line and securing a second portion to the first portion, the at least one electrically conductive element and plurality of sound producing units can be enclosed within the elongate substrate. An advantage of this configuration is that in such a manner, a barrier or decorative sign with a single outer protective layer can be easily manufactured.

In an embodiment, the substrate comprises two pieces of tape. The electrically conductive element and plurality of sound producing units can be arranged on a first piece of tape. A second piece of tape can be secured to the first piece of tape to enclose the electrically conductive element and plurality of sound producing units. An advantage of this configuration is that, in such a manner, a barrier or decorative sign with a single outer protective layer can be easily manufactured.

In an embodiment, the at least one electrically conductive element is a wire. In an embodiment, the at least one electrically conductive element is a conductive strip. In an embodiment, the at least one electrically conductive element is a conductive track.

In an embodiment, at least one of the plurality of sound producing units is a speaker. In other embodiments, the speaker is a relatively small speaker with a generally cylindrical shape having a diameter of, for example, approximately 10 to 40 millimeters, and a significantly smaller depth of, for example, 2 to 4 millimeters. An advantage of speakers with smaller depths is that such speakers are easier to house within the elongate substrate, and therefore reduces the complexity of manufacture. Such speakers also impact less on the physical requirements of the elongate substrate in which they are housed, and therefore allow a wider range of materials to be used for the substrate.

In an embodiment, at least one of the plurality of sound producing units is a piezoelectric unit. In other embodiments, the piezoelectric unit is a piezoelectric speaker or a piezo tweeter. An advantage of such a piezoelectric unit is the small size of such a unit, which enables easier construction of the apparatus as discussed above.

In an embodiment, the plurality of sound producing units are spaced substantially evenly along the elongate substrate. An advantage of an even spacing between sound producing units is that the apparatus may produce a substantially even audio output along its length.

In an embodiment, the plurality of sound producing units are spaced substantially unevenly along the elongate substrate. An advantage of an uneven spacing between sound producing units is that it allows audio output only at a specific portion of the apparatus, for example in between mounting posts.

In an embodiment, the elongate substrate is perforated to improve the sound emission of the sound producing units. The perforation is preferably aligned with and localized to the sound producing units. An advantage of a perforated elongate substrate is that the audio emission of the apparatus may be more efficient. The perforations may be covered with a waterproofing layer to protect the contents within the elongate substrate.

In an embodiment, the at least one conductive element and the plurality of sound producing units are coupled to form a parallel circuit. In an embodiment, the at least one conductive element and the plurality of sound producing units are coupled to form a series circuit.

In an embodiment, the elongate substrate is sealed. By sealing the elongate substrate, the enclosed contents are well protected. An advantage of having an apparatus formed from a single elongate substrate which is sealed is the manufacture of such an apparatus can be performed with lower complexity and thus reduced cost.

In an embodiment, the elongate substrate is heat sealed to enclose the plurality of sound producing units. In one embodiment, the elongate substrate is pressure sealed. In a further embodiment, the elongate substrate is chemically sealed. In other embodiments, the elongate substrate is sealed using a layer of adhesive. An advantage of using adhesive to form a sealed covering is that the components within the elongate substrate may be covered by the adhesive which may be waterproof and therefore form an additional protective layer.

In an embodiment, the apparatus comprises a power source. In an embodiment, the power source is a battery.

In an embodiment, the apparatus comprises a switch to activate and/or deactivate the plurality of sound producing units. In an embodiment, the switch is a button which is accessible to a user. Such a switch enables a user of the apparatus greater control of the audio output of the apparatus, which is advantageous when an output is desired only at specific times.

In an embodiment, the apparatus comprises an interface unit and a driving unit, wherein the driving unit supplies an input and the interface unit relays the input to the sound producing units.

In an embodiment, the interface unit comprises a plug-type connection. In another embodiment, the interface unit comprises a socket-type connection.

In an embodiment, the driving unit comprises a voltage source. In one embodiment, the driving unit comprises an audio source. In an embodiment, the driving unit includes a sensor. An advantage of the sensor is that the sensor is able to detect a change in surroundings and influence the output of the sound producing units. The sensors may, for example, be chosen or configured to sense a change in the amount of light. Accordingly, the driving unit may in turn send a signal in response to detecting an increase or decrease in light to increase or decrease the volume output of the sound producing units. This may be for example useful at night when the apparatus is less likely to be seen and so the reliance on the audible aspect of the apparatus is greater.

In an embodiment, the apparatus is a barrier apparatus.

According to a second aspect of the present invention, there is provided a method of manufacturing an apparatus with integrated audio, the method comprising:

providing an elongate substrate;

providing at least one electrically conductive element; and, providing a plurality of sound producing units, and spacing the plurality of sound producing units along the elongate substrate, and extending the at least one electrically conductive element along the elongate substrate and electrically coupling the at least one electrically conductive element to the plurality of sound producing units, and enclosing the plurality of sound producing units in the elongate substrate.

Suitably, the plurality of sound producing units are enclosed in a planar configuration.

In an embodiment, the apparatus is a barrier apparatus.

According to a third aspect of the present invention, there is provided a system comprising:

an element comprised of:

an elongate substrate;

at least one electrically conductive element; and, a plurality of sound producing units, wherein the plurality of sound producing units are spaced along the elongate substrate, and wherein the at least one conductive element extends along the elongate substrate and electrically couples to the plurality of sound producing units, and wherein the elongate substrate encloses the plurality of sound producing units, wherein the system further comprises a driving unit for providing an input to the element.

Suitably, the elongate substrate encloses the plurality of sound producing units in a planar configuration.

In an embodiment, the driving unit is integrated with the element. In an embodiment, the driving unit is separate from the element.

In an embodiment, the driving unit comprises at least two parts.

In an embodiment, at least one part of the driving unit is an integrated part of the element. In an embodiment, at least one part of the driving unit is separate from the element.

In an embodiment, the driving unit comprises a power source. In an embodiment, the driving unit comprises an audio source.

In an embodiment, the system further comprises an interface unit for relaying an input. In an embodiment, the interface unit comprises a sensor for sensing a change in surroundings of the system. In an embodiment, the interface unit comprises a switch for selectively relaying an input.

In a first configuration, the interface unit is integrated with the element. In second configuration, the interface unit is separate from the element. In a third configuration, the interface unit is integrated with the driving unit. In a fourth configuration, the interface unit is separate from the driving unit. In a fifth configuration, the interface unit comprises at least two parts. In a sixth configuration, at least one part of the interface unit is an integral part of the element. In a seventh configuration, at least one part of the interface unit is separate from the element. In an eighth configuration, at least one part of the interface unit is an integral part of the driving unit. In a ninth configuration, at least one part of the interface unit is separate from the driving unit.

In an embodiment, the interface unit comprises a plug-type connection. In another embodiment, the interface unit comprises a socket-type connection.

In an embodiment, the system is a barrier system. In an embodiment, the element is a barrier element.

Further features and advantages of the invention will become apparent from the following description of preferred embodiments of the invention, given by way of example only, which is made with reference to the accompanying drawings.

DETAILED DESCRIPTION OF CERTAIN INVENTIVE EMBODIMENTS

Figure 1A:
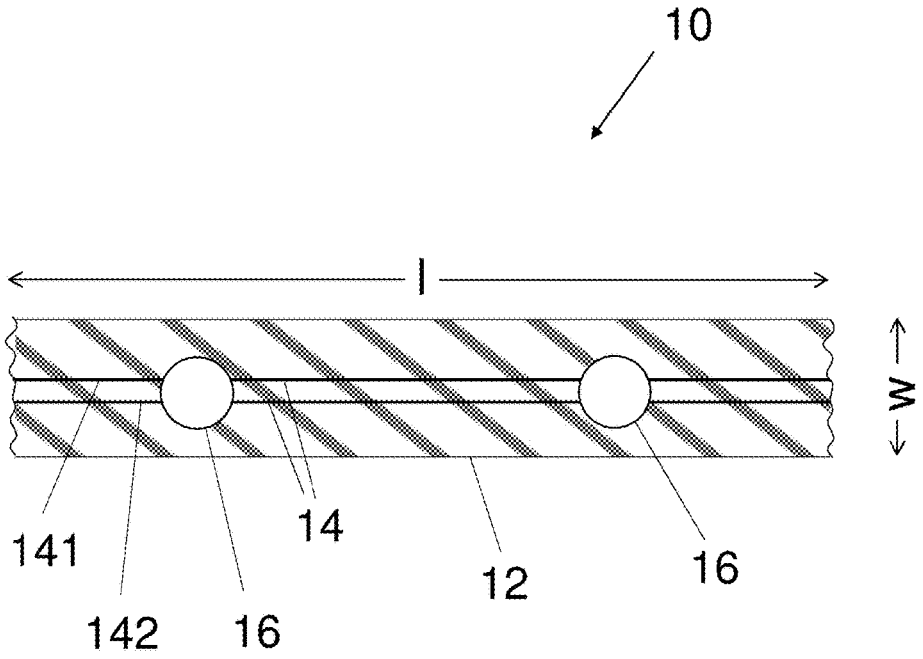
FIG. 1*a* is a schematic diagram showing a cross-sectional front view of an exemplary apparatus according to an embodiment of the present invention.

Referring initially to FIG. 1*a*, there is shown a schematic diagram of a barrier unit 10 according to an embodiment of the present invention. The barrier unit 10 comprises an elongate substrate 12 which when assembled encloses other components of the barrier unit 10. According to the example of FIG. 1*a*, the elongate substrate 12 is considerably greater in length l than both the width w and depth (not shown). The length l of the elongate substrate 12 can be several multiples of the width w. For example, the length l could be greater than one meter while the width w could be approximately 30 to 70 millimeters, or in a wider version up to 100 or 200 millimeters. In a further example, the width can exceed 200 millimeters when the unit is used for display purposes. In one example, the length of the elongate substrate can be significantly longer than 1 meter, for example several meters.

As shown in FIG. 1*a*, the barrier unit 10 also comprises two electrically conductive elements 14 which conduct electricity to components of the barrier unit 10. In one exemplary embodiment, the electrically conductive elements 14 extend along the elongate substrate 12. The electrically conductive elements 14 in a specific example extend along the length of the elongate substrate 12, as shown schematically in FIG. 1*a*, and are enclosed by the elongate substrate 12. The barrier unit 10 also comprises a plurality of sound producing units 16 which are also enclosed by the elongate substrate 12 of the barrier unit 10. The electrically conductive elements 14 which extend along the elongate substrate 12 electrically couple to the plurality of sound producing units 16. In one example, the sound producing units 16 are arranged in a spaced apart arrangement along the length of the elongate substrate 12.

The elongate substrate 12 may be formed of a flexible, durable material which can accommodate electrically conductive elements 14 and sound producing units 16 and enable the barrier unit 10 to stretch and bend when forces are applied to it. Suitable materials include, for example, sheet plastics or woven fabrics. In a specific example the elongate substrate 12 is made from polyethylene, polypropylene, nylon, or any other suitable material, and can be formed into a barrier or barricade tape or decorative sign. The elongate substrate may for example be made of high visibility material, or may include stripes, wording, designs or patterns on an external surface thereof. The material is preferably tear-proof. A flexible material for the elongate substrate 12, and preferably also for the conductive element 14, enables the barrier unit 10 to be rolled up, which in turn enables the barrier unit to be wound onto a reel. The winding of the barrier unit 10 onto a reel or roll facilitates more convenient storage and delivery compared to unwound barrier units. The winding also enables relatively long lengths of the barrier unit to be contained in a relatively small space which in turn makes transportation to, for example, a construction site, hazardous area or an emergency scene more convenient. A flexible material also enables the barrier unit 10 to be easily wrapped around posts or held by dedicated barrier fixings.

In another example, the elongate substrate 12 can be formed of an inflexible material which can accommodate the at least one electrically conductive element 14 and sound producing units 16 and which is resistant to movement when a force is applied to it. Suitable materials include, for example, hard plastics or metal. An inflexible material may be used to create a more permanent or sturdy barrier which may be more suitable at, for example, a hazardous site such as a quarry or a deep body of water.

The elongate substrate 12 may be configured as a planar substrate. The sound producing units 16 may be arranged within the elongate substrate 12 in a planar configuration. The planar arrangement of sound producing units 16 allows for an audible effect along the length of the barrier unit 10. The elongate substrate 12 in another example comprises a flattened tube with the sound producing units 16 enclosed within the tube.

The elongate substrate 12 forms a singular complete covering for the sound producing units 16 contained within it. In an example the covering for the sound producing units 16 is waterproof. This can be achieved by folding the elongate substrate 12 along its length and securing the sides. In an example, the elongate substrate 12 is formed of an upper portion of the substrate and a lower portion of the substrate. The upper portion and lower portion are separated by a fold line. The fold line extends along the length of the elongate substrate 12. In an example, the electrically conductive element 14 and plurality of sound producing units 16 are arranged within the upper portion. By folding the elongate substrate 12 along the fold line and securing the lower portion to the upper portion, the electrically conductive elements 14 and plurality of sound producing units 16 can be enclosed within the elongate substrate 12. The lower portion can be secured to the upper portion for example by any of heat sealing, pressure sealing, chemical sealing, or for example through use of adhesive or plastic welding.

In another example, the barrier unit 10 comprises two separate pieces of elongate substrate 12. The electrically conductive elements 14 and plurality of sound producing units 16 are arranged on a first piece of elongate substrate. The second piece of elongate substrate can be secured to the first piece of elongate substrate for example by any of heat sealing, pressure sealing, chemical sealing, or for example through use of adhesive or plastic welding.

In a specific example the exterior of the barrier unit 10 is a singular complete covering which encapsulates the components within it. This can be achieved by using a layer of adhesive to join two planar faces of the elongate substrate 12 together. An advantage of using adhesive to form a covering is that the components within the elongate substrate 1 may be covered by the adhesive which may be waterproof and therefore form an additional protective layer.

The barrier unit 10 of FIG. 1*a* may have a number of different applications and uses. One such application may be in construction or repair sites where the purpose may be to demarcate an area where construction or repair is taking place. The barrier unit 10 may act to warn, deter, or impede people or vehicles from entering the area that has been demarcated.

The barrier unit 10 can be used in applications where barricade tape, police tape, or firefighter tape is otherwise used. The barrier unit is a low-cost solution that can be attached quickly to posts or trees to provide a visual indication or sign of a hazardous or sensitive area, as well as a physical barrier to entering that area. In addition, the barrier unit can produce an audible signal through the sound producing units to further warn or deter people.

Decorative signs and banners may be constructed or configured using the same arrangement as in FIG. 1*a*. The application of these decorative signs and banners may be for parties or celebrations where an audible as well as visual message may be conveyed by the apparatus.

Figure 1B:
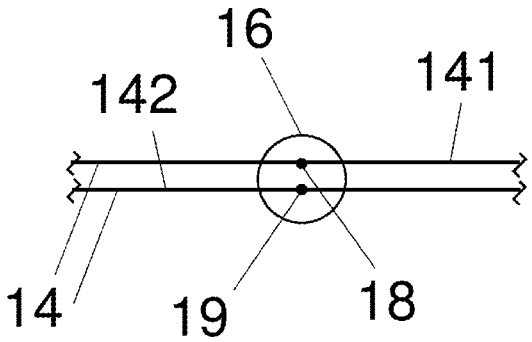
FIG. 1*b* is a schematic diagram showing a rear view of the sound producing unit and the conductive element from the apparatus of FIG. 1*a*.

As shown schematically in FIG. 1*b*, the sound producing units 16 are connected to electrically conductive element 14. In the example shown, the electrically conductive elements 14 comprise two parts 141,142. In an example the two parts are two separate wires 141 and 142. The sound producing units 16 are electrically coupled to wires 141,142 by point connections 18, 19. As shown in FIG. 1*b*, the system may have two wires 141,142 connecting the sound producing units 16 to, for example, a power source. The wires 141,142 may be made of, for example, copper, or any suitable conducting material. In other examples, each electrically conductive element 14 may be a conductive strip, conductive trace or conductive track to which the sound producing units 16 are connected.

Figure 2:
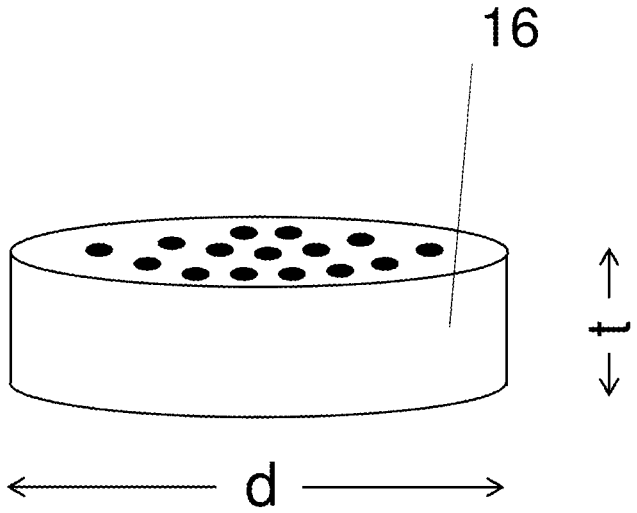
FIG. 2 is a side perspective view of an example of a sound producing unit.

FIG. 2 illustrates one of the sound producing units in the form of an audio speaker 16. Suitable audio speakers that can be arranged within an elongate substrate 12 may have a diameter d of, for example, 10 to 40 millimeters, and a significantly smaller depths t of, for example, 1 to 5 millimeters. Speakers with smaller depths are easier to house within the elongate substrate 12 and impact less on the physical requirements of the elongate substrate 12 in which they are housed. In another example at least one of the sound producing units 16 may be a piezoelectric unit, such as a piezoelectric speaker or piezo tweeter.

The sound producing units 16 may be positioned evenly along the elongate substrate 12. For example, the units 16 can be arranged approximately 0.5 to 1 m apart to enable an audible coverage along the length of the barrier unit 10. If the barrier unit 10 is to be used in particularly noisy environments, the sound producing units 16 may be arranged at shortened intervals from one another. If the barrier unit 10 is to be used in less noisy environments or locations where noise pollution from the sound producing units 16 is a concern the sound producing units 3 may be arranged less frequently along the elongate substrate 12.

If an audio output is desired only at a portion of the tape, for example at the ground level of a construction site where the barrier unit 10 covers many levels, the sound producing units 16 may be positioned unevenly along the elongate substrate 12. Audible (containing sound producing units 16) and non-audible (not containing sound producing units 16) sections of the barrier unit 10 may be indicated to a user through the use of different colored substrate.

Figure 3:
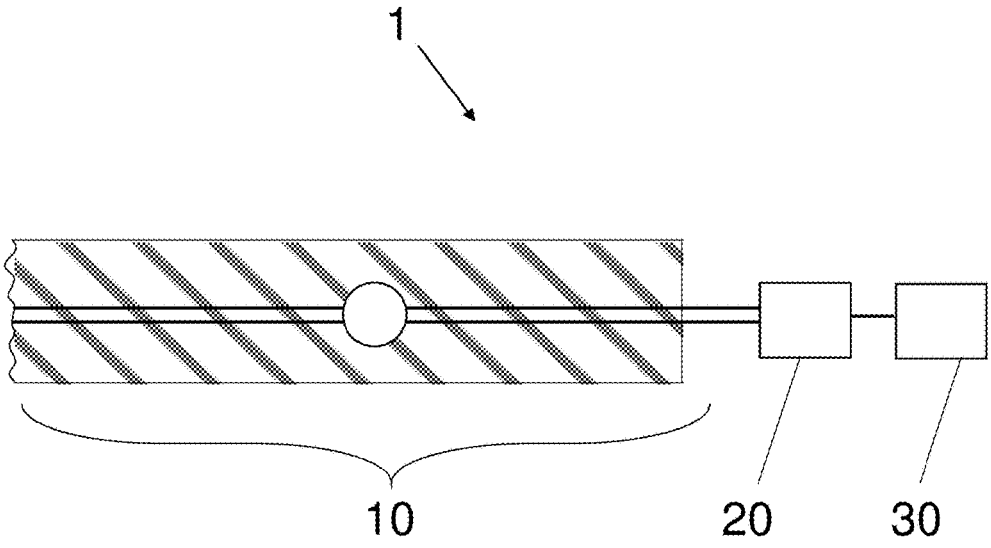
FIG. 3 is a schematic cross-sectional front view of the apparatus of FIG. 1 connected to an exemplary interface unit and driving unit.

Referring to FIG. 3, there is shown schematically a system for providing control of the audio output of the barrier unit or decorative signage unit 10. The system 1 comprises a barrier unit 10 similar to the barrier unit of FIG. 1*a*, an interface unit 20 and a driving unit 30. The interface unit 20 provides a link or interface between the barrier unit 10 and the driving unit 30. The interface unit 20 can relay input from the driving unit 30 to the barrier unit 10. Such an input includes, for example, an audio signal input and/or a power input. The driving unit 30 provides input for the barrier unit 10 and can send input to the interface unit 20, which in turn drives the sound producing units of the barrier unit 10 via the conductive element.

The interface unit 20 may in an example be a plug-type or a socket-type connection. In a specific example the interface unit 20 may be, for example, any of a jack connection, a Universal Serial Bus connection, a LAN cable connection, a switch, a sensor, a SCART connection or other suitable AV connection.

The driving unit 30 may be, in an example, a voltage supply, an audio supply or both. Specific examples of the driving unit 30 may include a power supply unit, battery, fuel cell, amplifier, smartphone, computer, tablet, radio, MP3 player and/or a microphone.

Figure 4:
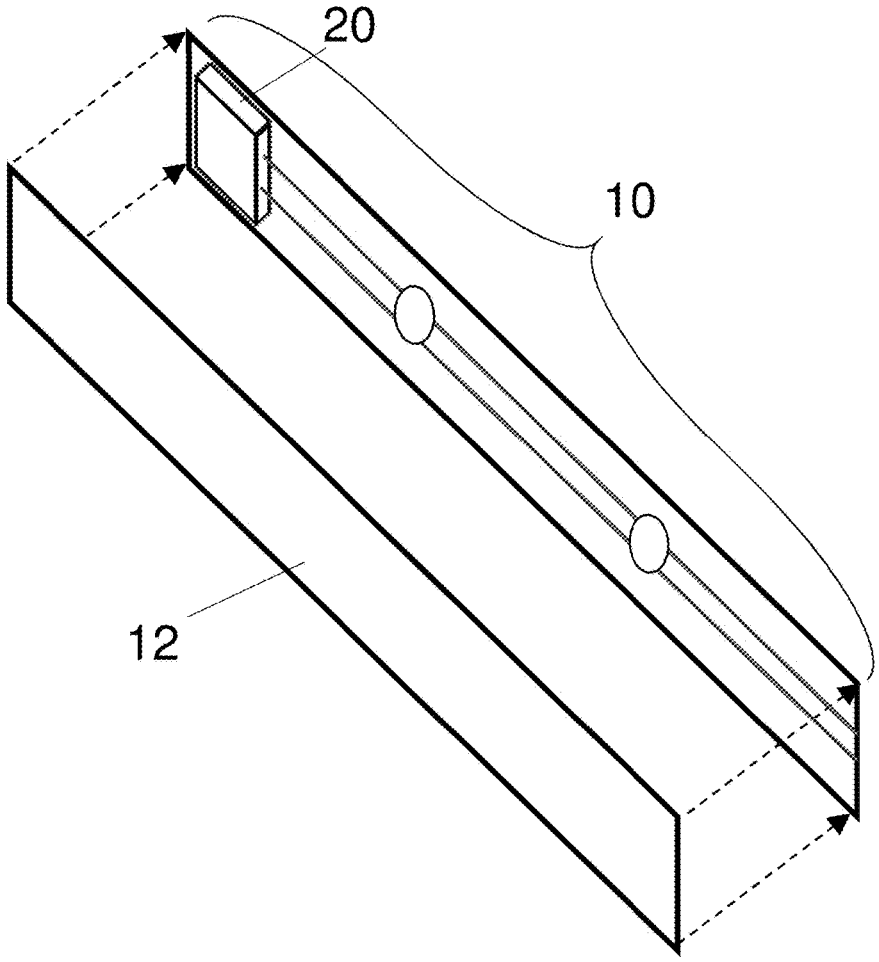
FIG. 4 is a schematic exploded perspective view of an example of an apparatus with integrated interface unit.

FIG. 4 shows an exploded perspective view of a barrier unit 10 with the interface unit 20 arranged integrally within the barrier unit 10. In this specific example, the driving unit 30 may be connected to the end of barrier unit 10 containing the interface unit 20. This arrangement may make transportation of the barrier system 1 easier, as the user need only transport the barrier unit 10 (containing the interface unit 20) and a driving unit 30, in order to provide an operational barrier system 1.

Figure 5:
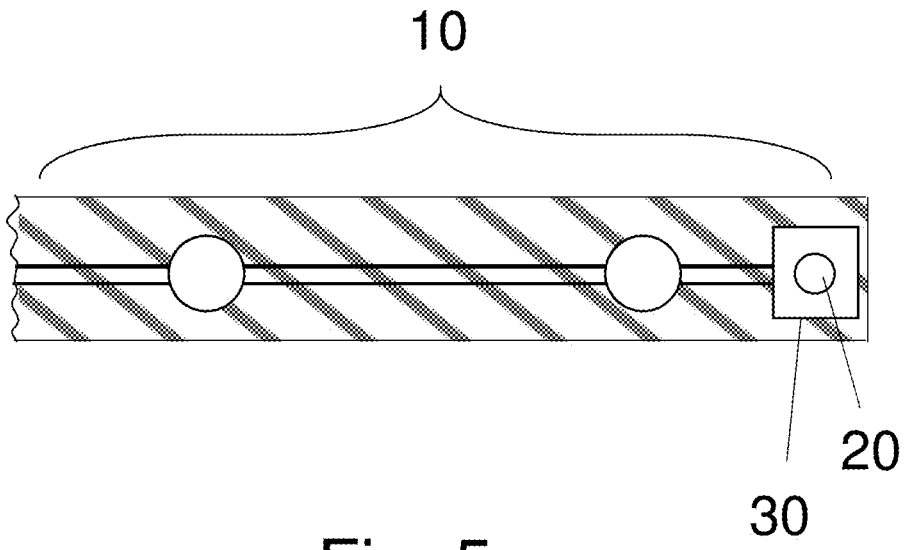
FIG. 5 is a schematic cross-sectional front view of an example of an apparatus with integrated driving unit.

FIG. 5 is a cross-sectional view of another example of a system 1 in which the driving unit 30 may be arranged integrally within the barrier unit or decorative signage unit 10. In the example shown, the driving unit 30 and interface unit 20 are integrated. In this specific example, the driving unit 30 comprises a click button (interface unit 20) and a power supply, such that the user can operate the sound producing units 16 within the barrier unit 10 with a single action. The audio signal can be generated within the driving unit 30 or within the sound producing units themselves. This arrangement may make transportation of the system 1 easier, as the user need only transport and assemble the barrier unit 10 as the driving unit 30, with integrated interface unit 20, is contained within it. The location of the driving unit 30 within the barrier unit 10 may be identified with different colored elongate substrate 12.

Figure 6A:
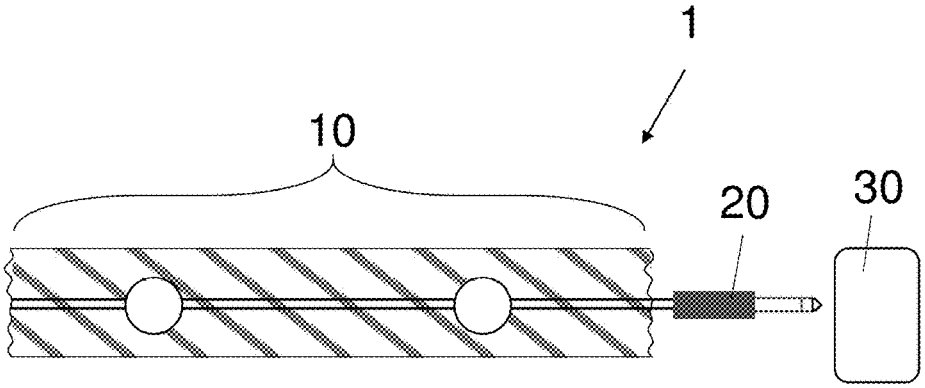
FIG. 6*a* is a schematic cross-sectional front view of a specific example of an apparatus connected to an interface unit and a driving unit.
Figure 6B:
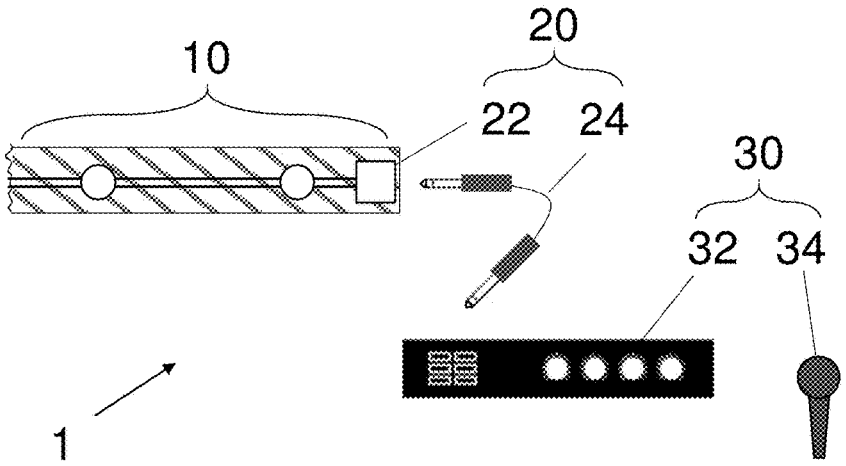
FIG. 6*b* is a schematic cross-sectional front view of a specific example of an apparatus connected to a partially-integrated two-part interface unit and a two-part driving unit.

Further examples of the system 1 are shown schematically in FIG. 6*a* and FIG. 6*b*. FIG. 6*a* is a cross-sectional side view of a barrier unit 10, interface unit 20 (in the form of a jack plug) and a driving unit 30 (in the form of a user device such as a mobile phone). FIG. 6*b* illustrates a system 1 comprising a barrier unit 10 with integrated interface unit box 22, interface unit jack-to-jack plug 24, driving unit box 32 and driving unit input device 34. In this specific example, the interface unit 20 and driving unit 30 are each formed of two parts. In other examples, the interface unit 20 and driving unit 30 may be formed of any number of parts. In the example shown in FIG. 6*b*, the interface unit box 22 may be a jack socket, the driving unit box 32 may be an amplifier, or any other audio processing device which may also be a power source, and the driving unit input device 34 may be a microphone, or any other audio generating device.

Figure 7:
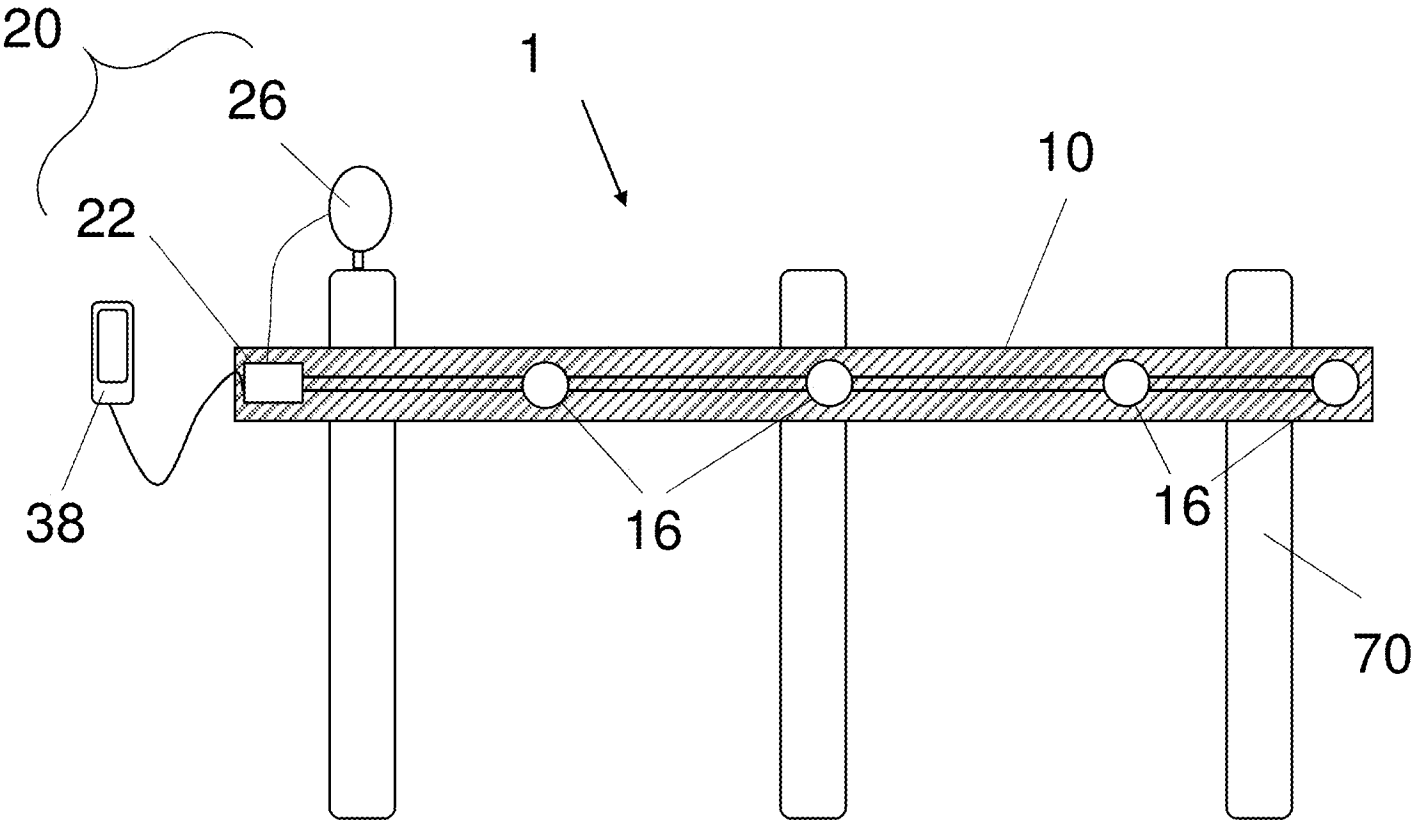
FIG. 7 is a schematic cross-sectional front view of a specific example of an apparatus in use connected to an integrated interface unit and a driving unit.

In another example, shown schematically in FIG. 7, the system 1 is shown assembled over posts 70. In use, the system 1 may be mounted on poles, posts or cones or draped from hinges, hooks or protrusions or tied across entrances, exits or cordoned spaces. In the example shown, part of the interface unit 22 is integrally assembled in the barrier unit 10. The driving unit in the example shown is the input device 38. The interface unit 20 is formed of a sensor 26 coupled to interface unit box 22. The sensor 26 is mounted on one of the posts 70 and is able to detect a change in surroundings and influence the output of the sound producing devices 16. For example, the sensor 26 may be a light sensor which senses a change in the amount of light and provides a signal to the interface unit box 22 such that the sound producing devices 16 are driven with a more powerful voltage to increase the audio volume. This would be useful at night when the barrier unit 10 is less likely to be seen and so the reliance on the audible aspect of the system 1 is increased.

In another example, the sensor 26 may be a motion sensor, and the system 1 may be configured such that the sound producing devices 16 only sound when a person approaches the system 1. In this way, power can be conserved when the system is not activated. A suitable sensor for detecting motion may be, for example, a passive infrared (PIR) sensor. In another example, the interface unit 20 is linked to, or comprises, a timed audio switch such that the output of the sound producing units 16 can be active only for certain periods. For example, the sound producing units 16 can remain active for a specified period after the sensor 26 has been activated, or can be activated and/or deactivated at certain times during the day.

An input device 38 as part of, or entirely as, the driving unit 30 can enable a user to control the output level of the sound producing units 16 so as to make the sound level suitable for the surroundings. The flexibility offered by such an arrangement enables the user greater control compared to, for example, adjusting the spacing of the sound producing units 16. In another example, each sound producing unit 16 may be configured such that a user may be able to selectively operate sound producing units 16. In an example, each sound producing unit 16 is controllable by a switch which can enable the sound producing unit 16 to function independently of the other sound producing units 16. Such a system may use digital control techniques for switching the sound producing units 16. The circuitry in the barrier system 1 may be series or parallel or a combination.

Figure 8A:
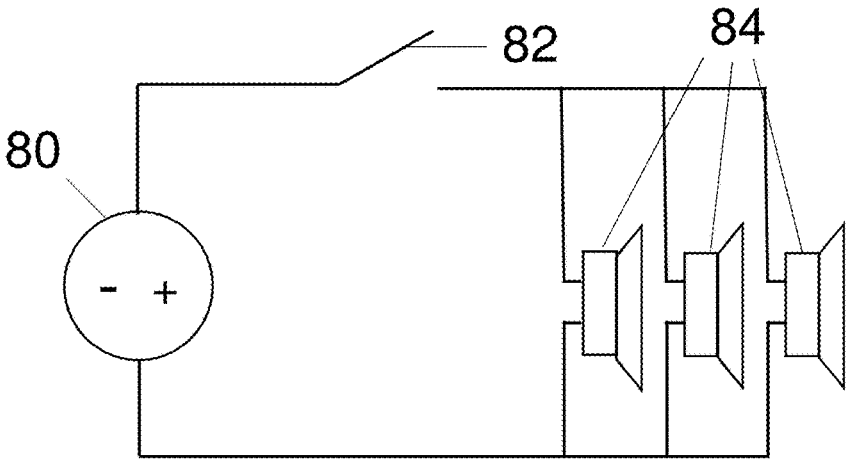
FIG. 8*a* is a simplified schematic diagram of exemplary parallel circuitry in an example of an apparatus.
Figure 8B:
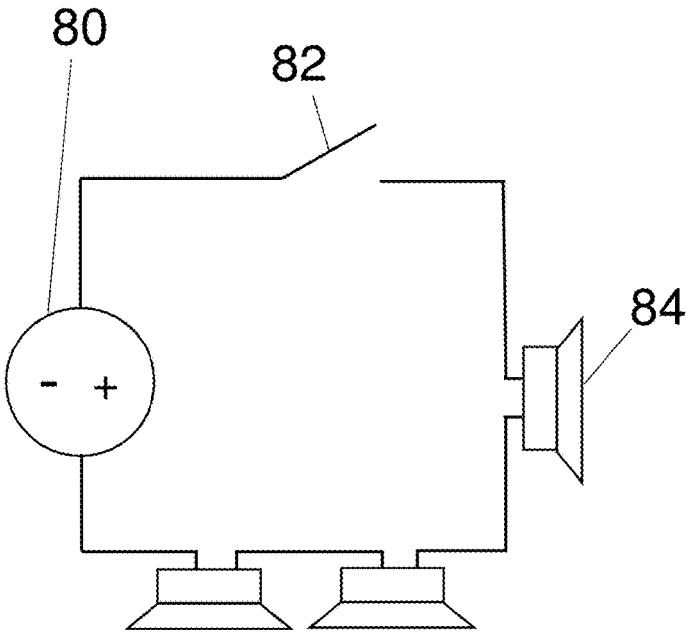
FIG. 8*b* is a simplified schematic diagram of exemplary series circuitry in an example of an apparatus.

FIG. 8*a* shows a circuit diagram of the electrical wiring of the conductive element 14, the sound producing units 16 and the power supply. The circuit diagram shows the sound producing units (shown as loudspeakers 84) connected in parallel with a voltage source 80 with a switch 82 to control the circuit. FIG. 8*b* shows a circuit diagram of the electrical wiring of the conductive element, the sound producing units and the power supply connected in series. The circuit diagram shows the sound producing unit connected to a voltage source 80 with a switch 82 to control the circuit. In an example the circuitry within the apparatus may be a combination of series and parallel circuitry. In another example, the parallel circuitry may include a switch before each loudspeaker 84 such that each loudspeaker 84 can be operated independently of the other loudspeakers. The voltage source 80 shown in these examples may be part of the driving unit 30. The switch 82 may be part of the interface unit 20. The level of the audio output of the loudspeakers 84 may be dependent on the voltage source 80, the number of sound producing units 16 and the circuitry of the apparatus. An example is shown in FIG. 9 using two wires 141,142 in a parallel arrangement.

Figure 9:
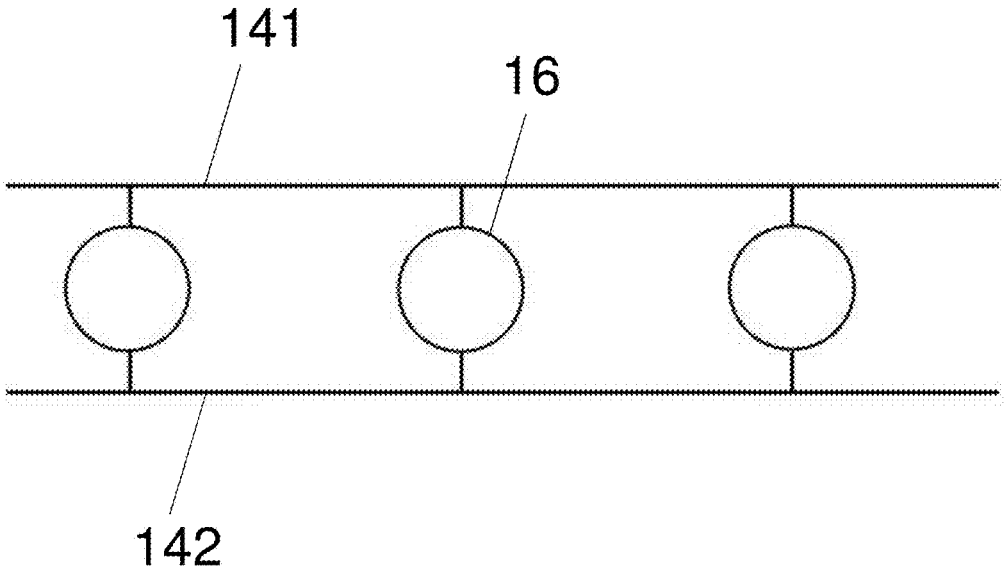
FIG. 9 is a schematic diagram of exemplary parallel circuitry for connecting sound producing units in an example of an apparatus.

FIG. 9 shows an example of circuitry which may be used in an example of the present invention. The repeating parallel circuit shown can be manufactured in a relatively long elongate substrate 12 which can then be cut to a desired length. In this example, a separate interface unit 20 and driving unit 30 (which may or may not be integrated) can be connected to the circuit to create a system 1. The driving unit 30 can include an adjustable output level that may be selected according to the number of sound producing units 16 in the system 1. This may be, for example, a volume control which enables suitable voltage to be sent through the circuitry.

To enhance the emission of the audio output from within the elongate substrate 12, the elongate substrate 12 may be perforated. The perforations may be covered with a waterproofing layer such as a silicone-based spray. The waterproofing spray may not significantly impact the emission of audio output but may protect the contents within the elongate substrate 12. The perforated elongate substrate may also be used without waterproofing in locations where, for example, weather is not a concern but the volume of the output is. Such locations include inside a train station, music venue or indoor athletics arena.

The above embodiments are to be understood as illustrative examples of the invention. Further embodiments of the invention are envisaged. For example, although the examples described refer to systems for barriers and barrier units, the disclosure is also relevant to decorative signage where a barrier function may not be necessary or required. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. A barrier tape for demarcating an area to provide an audible warning against entering the demarcated area, the barrier tape comprising:

an elongate substrate;

at least one electrically conductive element; and a plurality of sound producing units, wherein the plurality of sound producing units are arranged along and enclosed within the elongate substrate, wherein the at least one electrically conductive element extends along and within the elongate substrate and electrically couples to the plurality of sound producing units, and wherein the elongate substrate comprises a flattened tube with the sound producing units enclosed within the tube, the flattened tube formed of an upper and lower portion and a front and back surface, and wherein the upper and lower portions are contiguous between the front and back surfaces such that the elongate substrate forms a singular complete covering for the sound producing units.

2. The barrier tape of claim 1, wherein the elongate substrate encloses the plurality of sound producing units in a planar configuration.

3. The barrier tape of claim 1, wherein the substrate is a planar substrate.

4. The barrier tape of claim 1, wherein the substrate is flexible.

5. The barrier tape of claim 1, wherein the substrate comprises a tape folded along its length.

6. The barrier tape of claim 1, wherein at least one of the plurality of sound producing units is a speaker.

7. The barrier tape of claim 1, wherein at least one of the plurality of sound producing units is a piezoelectric unit.

8. The barrier tape of claim 1, wherein the elongate substrate is perforated to improve the sound emission of the barrier element.

9. The barrier tape of claim 1, wherein the elongate substrate is sealed.

10. The barrier tape of claim 1, comprising a power source.

11. The barrier tape of claim 1, comprising an interface unit and a driving unit, wherein the driving unit supplies an input and the interface unit relays the input.

12. The barrier tape of claim 1, comprising an interface unit and a driving unit, wherein the driving unit supplies an input and the interface unit relays the input and wherein the driving unit comprises a voltage source.

13. The barrier tape of claim 1, comprising an interface unit and a driving unit, wherein the driving unit supplies an input and the interface unit relays the input and wherein the driving unit comprises an audio source.

14. The barrier tape of claim 1 comprising an interface unit and a driving unit, wherein the driving unit supplies an input and the interface unit relays the input and wherein the driving unit comprises a sensor.

15. A method of manufacturing a barrier tape for attaching to posts to demarcate an area and to provide an audible signal to warn against entering the demarcated area, the method comprising:

providing an elongate substrate comprising a flattened tube formed of an upper and lower portion and a front and back surface, and wherein the upper and lower portions are contiguous between the front and back surfaces;

providing at least one electrically conductive element;

providing a plurality of sound producing units;

arranging the plurality of sound producing units along and within the flattened tube of the elongate substrate;

extending the at least one electrically conductive element along and within the elongate substrate and electrically coupling the at least one electrically conductive element to the plurality of sound producing units; and enclosing the plurality of sound producing units within the elongate substrate such that the elongate substrate forms a singular complete covering for the sound producing units.

16. The method of claim 15, wherein the enclosing the plurality of sound producing units in the elongate substrate is in a planar configuration.

17. A system comprising:

a barrier tape for demarcating an area and providing an audible warning against entering the demarcated area, the barrier tape comprising:

an elongate substrate;

at least one electrically conductive element; and a plurality of sound producing units; and a driving unit for providing an input to the element, wherein the plurality of sound producing units are arranged along and enclosed within the elongate substrate, wherein the at least one conductive element extends along and within the elongate substrate and electrically couples to the plurality of sound producing units, and wherein the elongate substrate comprises a flattened tube with the sound producing units enclosed within the tube, the flattened tube formed of an upper and lower portion and a front and back surface, and wherein the upper and lower portions are contiguous between the front and back surfaces such that the elongate substrate forms a singular complete covering for the sound producing units.

18. The system of claim 17, wherein the elongate substrate encloses the plurality of sound producing units in a planar configuration.

19. The system of claim 17, further comprising an interface unit for relaying an input.

* * * * *